US011241773B2

(12) United States Patent
Roberts et al.

(10) Patent No.: US 11,241,773 B2
(45) Date of Patent: Feb. 8, 2022

(54) TOOL FOR SECURING A CLAMP

(71) Applicant: Oetiker Tool Corporation, Branford, CT (US)

(72) Inventors: Jeremy Roberts, Guilford, CT (US); Joseph Krzyzanski, New Haven, CT (US); Charlie Gargano, Guilford, CT (US); Scott Wetzel, Milford, CT (US); Richard Steiner, East Haddam, CT (US)

(73) Assignee: OETIKER TOOL CORPORATION, Branford, CT (US)

( * ) Notice: Subject to any disclaimer, the term of this patent is extended or adjusted under 35 U.S.C. 154(b) by 304 days.

(21) Appl. No.: 16/470,001

(22) PCT Filed: Jan. 3, 2018

(86) PCT No.: PCT/US2018/012142
§ 371 (c)(1),
(2) Date: Jun. 14, 2019

(87) PCT Pub. No.: WO2018/132282
PCT Pub. Date: Jul. 19, 2018

(65) Prior Publication Data

US 2019/0351536 A1 Nov. 21, 2019

Related U.S. Application Data

(60) Provisional application No. 62/445,357, filed on Jan. 12, 2017.

(51) Int. Cl.
*B25B 25/00* (2006.01)
*B25B 7/02* (2006.01)
(Continued)

(52) U.S. Cl.
CPC ..... *B25B 25/005* (2013.01); *B25B 7/02* (2013.01); *B25B 7/12* (2013.01); *B25B 23/1427* (2013.01); *B25G 1/066* (2013.01)

(58) Field of Classification Search
CPC ..... B25B 25/005; B25B 7/02; B25B 7/12; B25B 23/1427; B25G 1/066
See application file for complete search history.

(56) References Cited

U.S. PATENT DOCUMENTS 4,742,736 A 5/1988 Williams
5,174,177 A 12/1992 Jeromson, Jr. et al.
(Continued)

FOREIGN PATENT DOCUMENTS

CN 101637890 A 2/2010
DE 202004015720 U1 1/2005
(Continued)

OTHER PUBLICATIONS

Japanese Office Action dated Jul. 28, 2020.
(Continued)

*Primary Examiner* — David B. Thomas
(74) *Attorney, Agent, or Firm* — Cantor Colburn LLP

(57) ABSTRACT

A tool and method of securing a clamp is provided. The tool includes a first handle having a first jaw portion on one end. An arm is pivotally coupled to the first handle, the having a second jaw portion on one end. A second handle is adjacent the first handle. A force adjustment mechanism is rotatably coupled between the arm and the second handle. The force adjustment mechanism has a biasing member operably coupled between the arm and an adjustment member, the force adjustment mechanism further having at least one bearing member disposed between the arm and the adjustment member. The second handle is arranged to rotate relative to the arm based at least in part on a force applied
(Continued)

on the second handle by the biasing member via the at least one bearing member.

20 Claims, 8 Drawing Sheets

(51) Int. Cl.

| | |
|---|---|
| ***B25B 7/12*** | (2006.01) |
| ***B25B 23/142*** | (2006.01) |
| ***B25G 1/06*** | (2006.01) |

(56) References Cited

U.S. PATENT DOCUMENTS

| | | | | |
|---|---|---|---|---|
| 8,429,948 | B1 | 4/2013 | Warren | |
| 10,144,117 | B2 * | 12/2018 | Khristyuchenko | ..... B25B 7/10 |
| 2004/0154441 | A1 | 8/2004 | Wickes et al. | |
| 2007/0056412 | A1 | 3/2007 | Wolfson | |
| 2008/0168870 | A1 | 7/2008 | Caravello | |
| 2012/0111157 | A1 | 5/2012 | Qiu | |
| 2014/0033182 | A1 | 1/2014 | Ashish et al. | |
| 2014/0331825 | A1 | 11/2014 | Khristyuchenko et al. | |

FOREIGN PATENT DOCUMENTS

| | | | |
|---|---|---|---|
| EP | 2826595 | A1 | 1/2015 |
| FR | 2317051 | A1 | 2/1977 |
| JP | H11156738 | A | 6/1999 |
| JP | 3058628 | B1 | 7/2000 |
| JP | 2000271873 | A | 10/2000 |
| KR | 20150145909 | A | 12/2015 |
| WO | 2014003346 | A1 | 1/2014 |

OTHER PUBLICATIONS

European Search Report dated Aug. 3, 2020.
International Search Report and Written Opinion for International Application No. PCT/US2018/12142 dated May 2, 2018; 15 pgs.
Chinese Office Action for Application No. 201880005099.0 dated May 27, 2020; 7 pgs.

* cited by examiner

TOOL FOR SECURING A CLAMP

BACKGROUND OF THE DISCLOSURE

The subject matter disclosed herein relates to a hand tool for securing a clamp, such as a band-type clamp. In particular, the subject matter disclosed herein relates to a hand tool for tightening and securing band clamp with a preset force.

Clamps are used in a wide variety of applications for securing conduits to fittings. One type of clamp, generally referred to as a band clamp, includes a cylindrically shaped strip of material having overlapping ends. By moving one end of the strip, the diameter of the clamp may be changed. When the clamp is placed over a conduit, the reduction of the diameter secures the conduit onto a fitting. One type of band clamp uses a worm drive mechanism, which allows the installer to turn the worm drive (typically with a screwdriver) to adjust the diameter of the clamp. It should be appreciated that the installer may adjust the amount of clamping pressure that is applied by actuating the worm drive.

Another type of band clamp is sometimes referred to as an ear clamp. In these types of clamps, the band includes a u-shaped raised portion on the outer layer of the band. A tool, having pincher jaws is used to grab the raised portion and deform the raised portion by displacing the outer sides of the raised portion inward. This deformation reduces the diameter of the band to secure the conduit to the fitting. These types of band clamps have advantages in that they are less expensive to produce and since the raised portion is permanently deformed, form a reliable connection. It should be appreciated that the amount of force applied by the installer may vary depending on the amount of force applied by the installer on the tool.

Accordingly, while existing tools for tightening and securing band clamps are suitable for their intended purpose the need for improvement remains, particularly in providing a tool that applies a predetermined amount of force on the band clamp.

BRIEF DESCRIPTION OF THE DISCLOSURE

According to one aspect of the disclosure, a tool for securing a clamp is provided. The tool includes a first handle having a first jaw portion on one end. An arm is pivotally coupled to the first handle, the having a second jaw portion on one end. A second handle is adjacent the first handle. A force adjustment mechanism is rotatably coupled between the arm and the second handle. The force adjustment mechanism has a biasing member operably coupled between the arm and an adjustment member, the force adjustment mechanism further having at least one bearing member disposed between the arm and the adjustment member. The second handle is arranged to rotate relative to the arm based at least in part on a force applied on the second handle by the biasing member via the at least one bearing member.

According to another aspect of the disclosure, a method of securing a clamp is provided. The method includes providing a tool. The tool comprises a first handle having a first jaw portion on one end. An arm is pivotally coupled to the first handle, the having a second jaw portion on one end. A second handle is adjacent the first handle. A force adjustment mechanism is rotatably coupled between the arm and the second handle, the force adjustment mechanism having a biasing member operably coupled between the arm and an adjustment member, the force adjustment mechanism further having at least one bearing member disposed between the arm and the adjustment member. The method includes engaging a raised portion of the clamp between the first jaw portion and the second jaw portion. A force is applied to the first handle and the second handle. The second handle is rotated relative to the arm when the force is equal to or exceeds a predetermined force.

These and other advantages and features will become more apparent from the following description taken in conjunction with the drawings.

BRIEF DESCRIPTION OF DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

The detailed description explains embodiments of the disclosure, together with advantages and features, by way of example with reference to the drawings.

DETAILED DESCRIPTION OF THE DISCLOSURE

Embodiments of the present invention provide advantages in the securing of clamps, such as band clamps, at a predetermined force level. Embodiments of the present invention provide further advantages in allowing the predetermined force level to be user selectable. Embodiments of the present invention further provide advantages in preventing application of a force greater than the predetermined force to the clamp.

Figure 1:
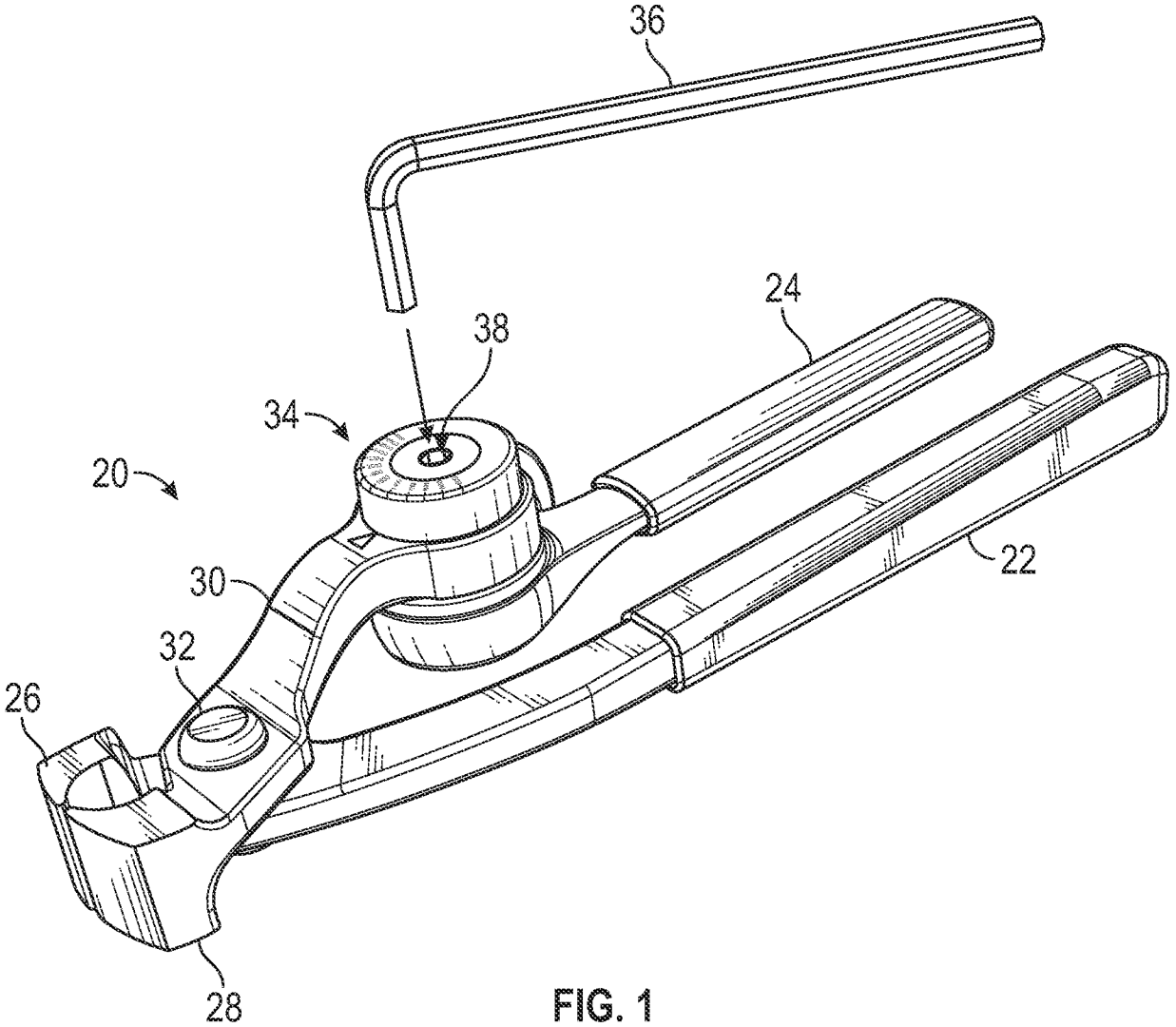
FIG. 1 is a perspective view of a tool for securing a clamp in accordance with an embodiment.

Referring now to FIG. 1, an embodiment is shown of a tool 20 for securing clamps, such as band clamps for example. The tool 20 includes a first handle 22 and a second handle 24 that are sized and shaped to be grasped by a user's hand or hands. The first handle 22 includes a first jaw portion 26 on one end. As will be discussed in more detail herein, the first jaw portion 26 cooperates with a second jaw portion 28 on an arm 30 to deform a portion of the clamp, such as the raised portion for example, when the clamp is secured.

The arm 30 is pivotally coupled to the first handle 22 by a pivot member 32. The arm 30 is further rotationally coupled to the second handle 24 by a force adjustment mechanism 34. As will be discussed in more detail herein, the force adjustment mechanism 34 allows the user to select a predetermined force level that may be applied by the jaw portions 26, 28 to the clamp. In an embodiment, the predetermined force level is selected or adjusted using a tool 36, such as an Allen key for example, that is inserted in an appropriately shaped opening 38 of the force adjustment mechanism 34.

Figure 2:
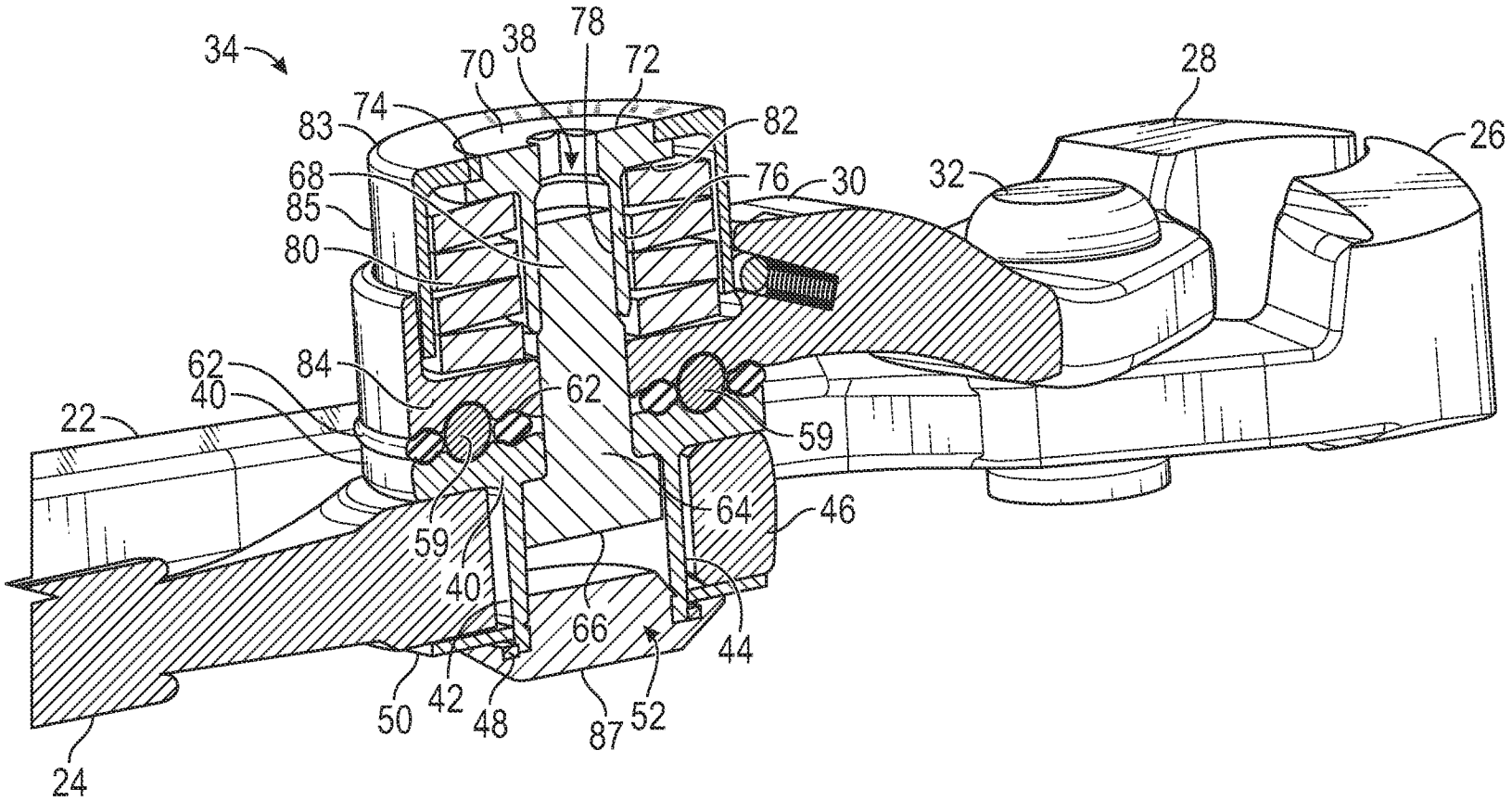
FIG. 2 is a partial sectional view of the tool of FIG. 1.
Figure 3:
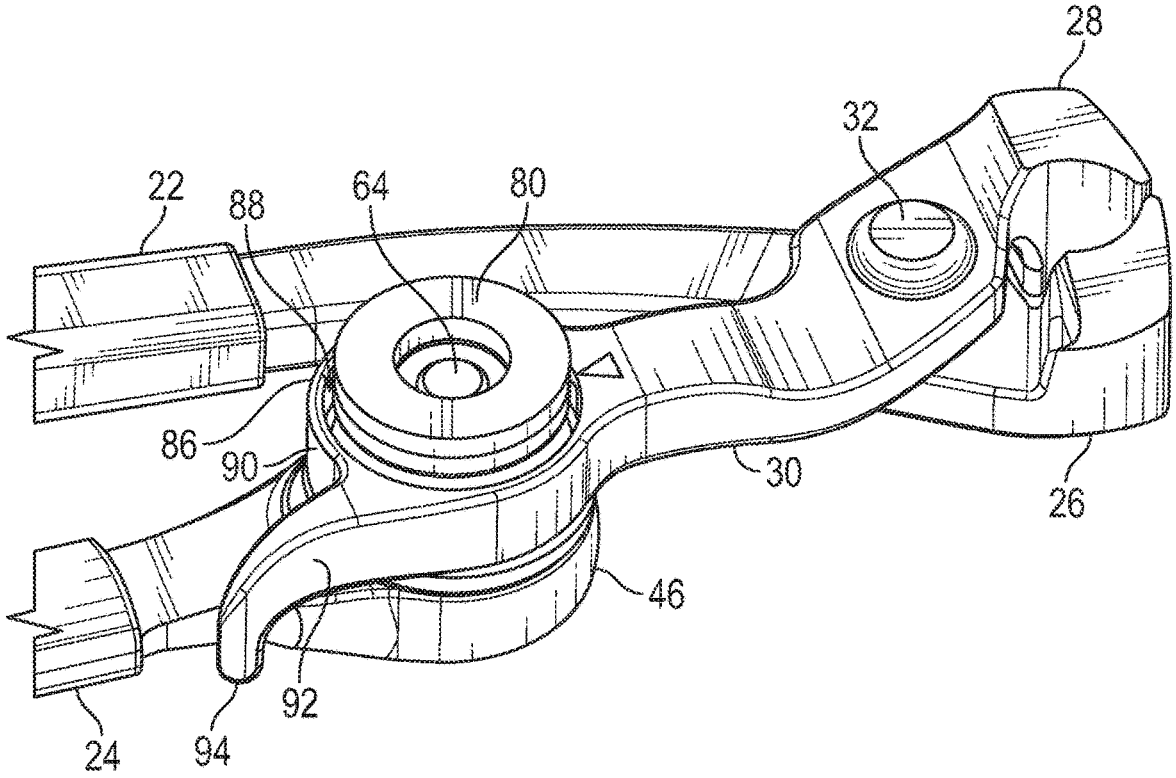
FIG. 3 is a partial perspective view of the tool of FIG. 1 with a cover portion of the force adjustment mechanism removed.
Figure 6:
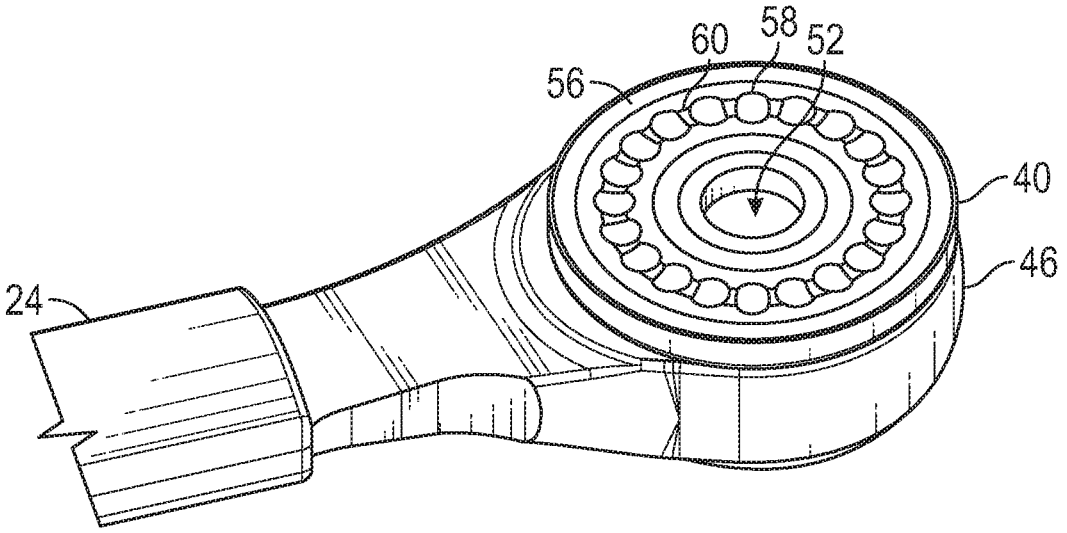
FIG. 6 is a partial perspective view of the tool of FIG. 5 with bearing and o-rings removed.

Referring now to FIG. 2, an embodiment is shown of the force adjustment mechanism 34. The mechanism 34 includes a breakaway member 40 that includes a hexagonal projection 42 that extends into an opening 44 in end 46 of the second handle 24. In the exemplary embodiment, the breakaway member 40 is coupled to the second handle 24 by a retaining ring 48 (e.g. a snap-ring) and a washer 50. The projection 42 includes an opening 52 that extends coaxially therethrough. The breakaway member 40 further includes a top surface 56 (FIG. 6) that includes a first plurality of recesses 58 and a second plurality of recesses 60. In an embodiment, each of the second plurality of recesses 60 are disposed between two adjacent recesses of the first plurality of recesses 58. The first plurality of recesses 58 are equally spaced apart at a diameter relative to an axis extending through the opening 52. As will be discussed in more detail herein, the first plurality of recesses are sized to receive one or more bearing members 59, such as a ball bearing for example. The breakaway member 40 may further include features, such as circular slots for example, that are sized to receive seals or o-rings 62.

The mechanism 34 further includes a fastener 64 having a cylindrical head portion 66 and a body portion 68. In an embodiment, the body portion 68 includes screw threads about an outer diameter. In the exemplary embodiment, the body portion 68 may further include a flat surface 100(FIG. 4) along a portion of the outer diameter that is positioned to engage a corresponding surface on the arm 30. The flat surface 100 prevents relative rotational movement between the fastener 64 and the arm 30. As will be discussed in more detail herein, the fastener 64 may rotate relative to the breakaway member 40.

The fastener 64 engages an adjustment member 70. The adjustment member 70 includes a body portion 72 having a lip 74. The opening 38 extends through the body portion 72. The fastener 64 further includes a cylindrical projection 76 that extends from the body portion 72. The projection 76 includes a threaded internal opening 78 that is configured to engage the threaded portion of fastener 64 and couple the adjustment member 70 and fastener 64. A biasing member 80 is disposed between a bottom surface 82 of the body portion 72 and a wall 84 of arm 30. In the exemplary embodiment, the biasing member 80 is a plurality of Bellville or spring washers.

The wall 84 is disposed opposite the top surface 56 of the breakaway member 40 with the bearing members 59 disposed therebetween. It should be appreciated that as the adjustment member 70 is rotated, the adjustment member 70 will move along and relative to the body portion 68 of the fastener 64. Due to the engagement of the head portion 66 on the breakaway member 40, the movement of the adjustment member 70 will change the amount of force imparted by the biasing member 80. As will be discussed in more detail herein, the force applied by the biasing member 80 will determine the amount of force that may be applied to the second handle 24 before the breakaway member 40 rotates relative to the arm 30.

One end of the force adjustment mechanism 34 is enclosed by a cover member 83 having a side wall 85 that extends about the biasing member 80. In an embodiment, the cover member 83 includes indicia that allows the user to determine the amount of predetermined force may be applied by the jaw portions 26, 28. The opposing end of the mechanism 34 is enclosed by a cover 87. In an embodiment, the cover 87 is coupled to the second handle 24 by a snap-fit. In an embodiment, the indicia or scale on the cover 83 may be calibrated using a gage (not shown). The user first removes the cover 30 and places the tips of the jaws 26, 28 onto a calibration gage, such as a gage that measures an applied force and includes a digital readout for example. An Allen or hex key is placed into the opening 38 and turned until resistance is felt. The hex key is that turned one complete revolution. The hex key is removed and the handles are closed until the handle 24 releases. The handle is cycled several times to record the release force. The average release force is determined and the cover 30 is pressed into place with the indicia for the appropriate force reading aligned with the indicator (e.g. arrow 108, FIG. 7).

Figure 4:
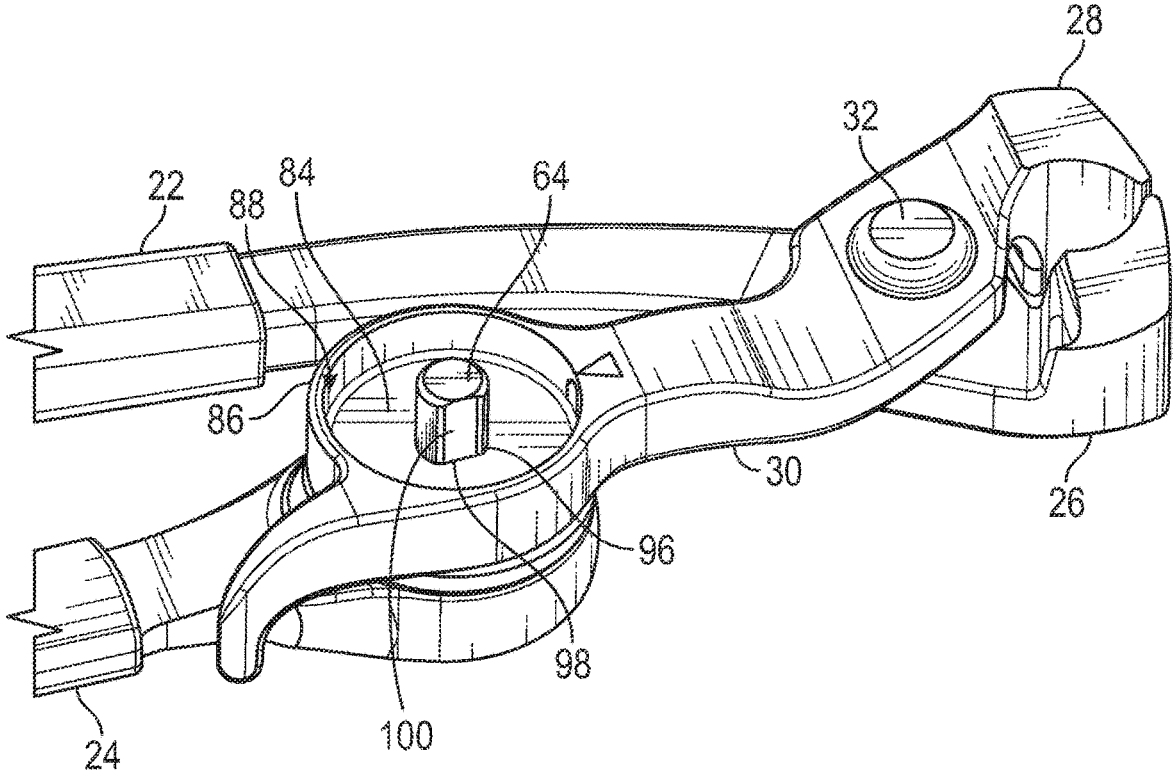
FIG. 4 is a partial perspective view of the tool of FIG. 3 with a biasing member removed.
Figure 5:
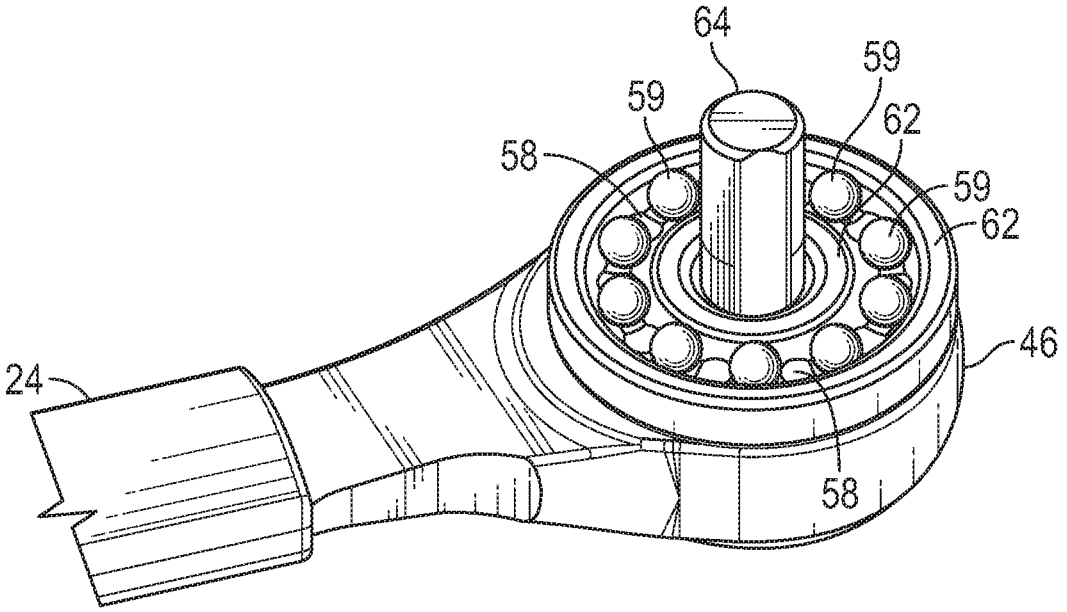
FIG. 5 is a partial perspective view of the tool of FIG. 4 with an arm member removed.

Referring now to FIGS. 3-6, an embodiment is shown of the arm 30 and the force adjustment mechanism 34. In this embodiment, an end 86 of the arm 30 is arranged opposite the jaw portion 28 and defines a cup-shaped recessed area 88. The recessed area 88 is defined by a side wall 90 and the bottom wall 84 (FIG. 4). The biasing members 80 are sized to be at least partially disposed within the recessed area 88. In an embodiment, the side wall 85 of cover member 83 extends into the recessed area 88 between the biasing members 80 and the side wall 90. The end 86 may include a curved arm member 92 that extends from the side wall 90 and has an end 94 that extends adjacent the second handle 24. The end 94 is a stop member that limits the rotational travel of the second handle 24 relative to the arm 30.

An opening 96 is formed in the bottom wall 84 to allow the fastener 64 to extend therethrough. In the exemplary embodiment, the opening 96 includes a flat portion 98 that engages the flat surface 100 on the fastener 64 to prevent relative rotational movement between the fastener 64 and the arm 30.

In the exemplary embodiment, on an opposite side of the wall 84 from the biasing members 80, a plurality of bearing members 59 and seals 62 are disposed between the surface of the wall 84 and the top surface 56 of breakaway member 40. In one embodiment, the number of bearing members 59 provided are to half of the number of recesses 58 so that a bearing member 59 is disposed in every other recess 58. For example, in an embodiment, twenty recesses 58 and ten bearing members 59 are provided.

Figure 11:
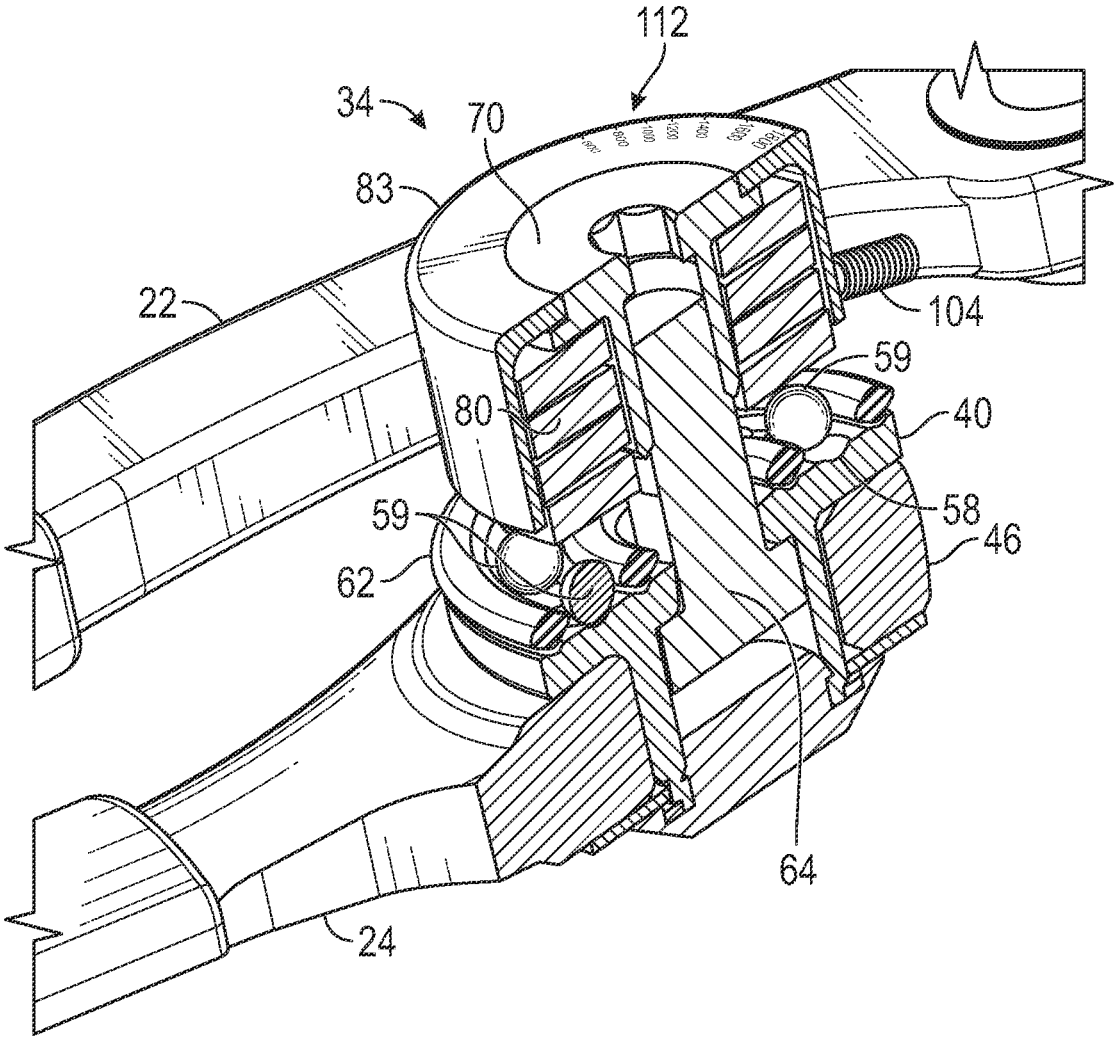
FIG. 11 is a partial sectional view of the tool of FIG. 10 with the arm member removed.

As discussed herein, the movement of the adjustment member 70 changes the amount of force the biasing member 80 applies to the wall 84, and thus to the bearing members 59 and the breakaway member 40. When a force that is equal to or greater than a predetermined force is applied to the handles 22, 24, the force will overcome the biasing force from biasing member 80 and allow the handle 24 and breakaway member 40 to rotate relative to the arm 30. When this occurs, the bearing members 59 will move from their initial position to adjacent recesses 58 via intermediate recesses 60. When this occurs, the force of the bearing members 59 will compress the biasing member 80 to allow the displacement of the wall 84 relative to the breakaway member 40(FIG. 11). Thus, the amount of force that may be applied to the jaw portions 26, 28 may be limited by changing the position of the adjustment member 70.

Figure 7:
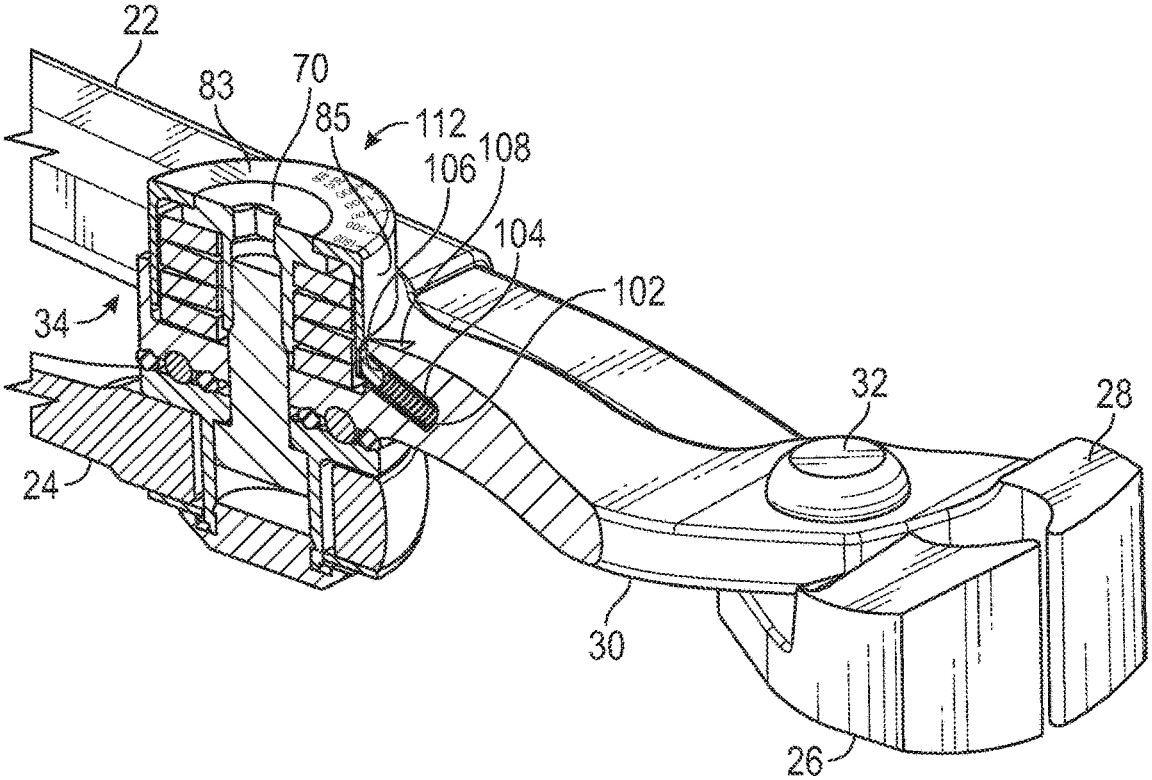
FIG. 7 is another partial sectional view of the tool of FIG. 1.
Figure 8:
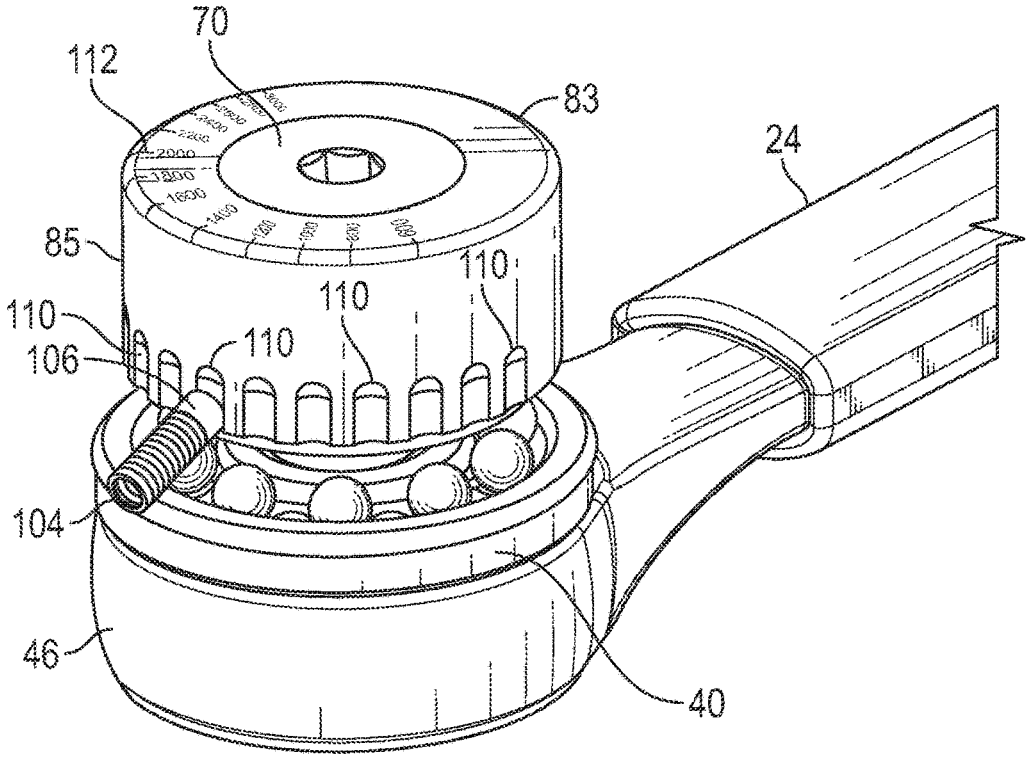
FIG. 8 is a partial perspective view of the tool of FIG. 1 with the arm member removed.

Referring now to FIG. 7 and FIG. 8 and embodiment is shown for providing feedback to the user in the adjustment of the predetermined force. In this embodiment, the arm 30 includes a blind hole 102. Disposed within the hole 102 is a second biasing member 104, such as a compression spring for example. Disposed on the end of the biasing member 102 is a curved member, such as a ball bearing 106. In the exemplary embodiment, the hole 102 is aligned with an indicator 108.

The ball bearing 106 cooperates with slots 110 (FIG. 7) formed circumferentially along the outer diameter of side wall 85 to form detent. It should be appreciated that the interaction between the bearing 106 and the slots 110 provides a tactile response to the user that they have rotated the adjustment member by an increment. It should also be appreciated that the force applied by the spring 104 via the ball bearing 106 against the slot 110 also assists in maintaining the cover 83 and the adjustment member 70 in the desired position. In the exemplary embodiment, the slots 110 are aligned with indicia 112 that provide the user with an indication of the level of the predetermined force that will be applied by the jaw portions 26, 28 on the clamp.

Figure 9:
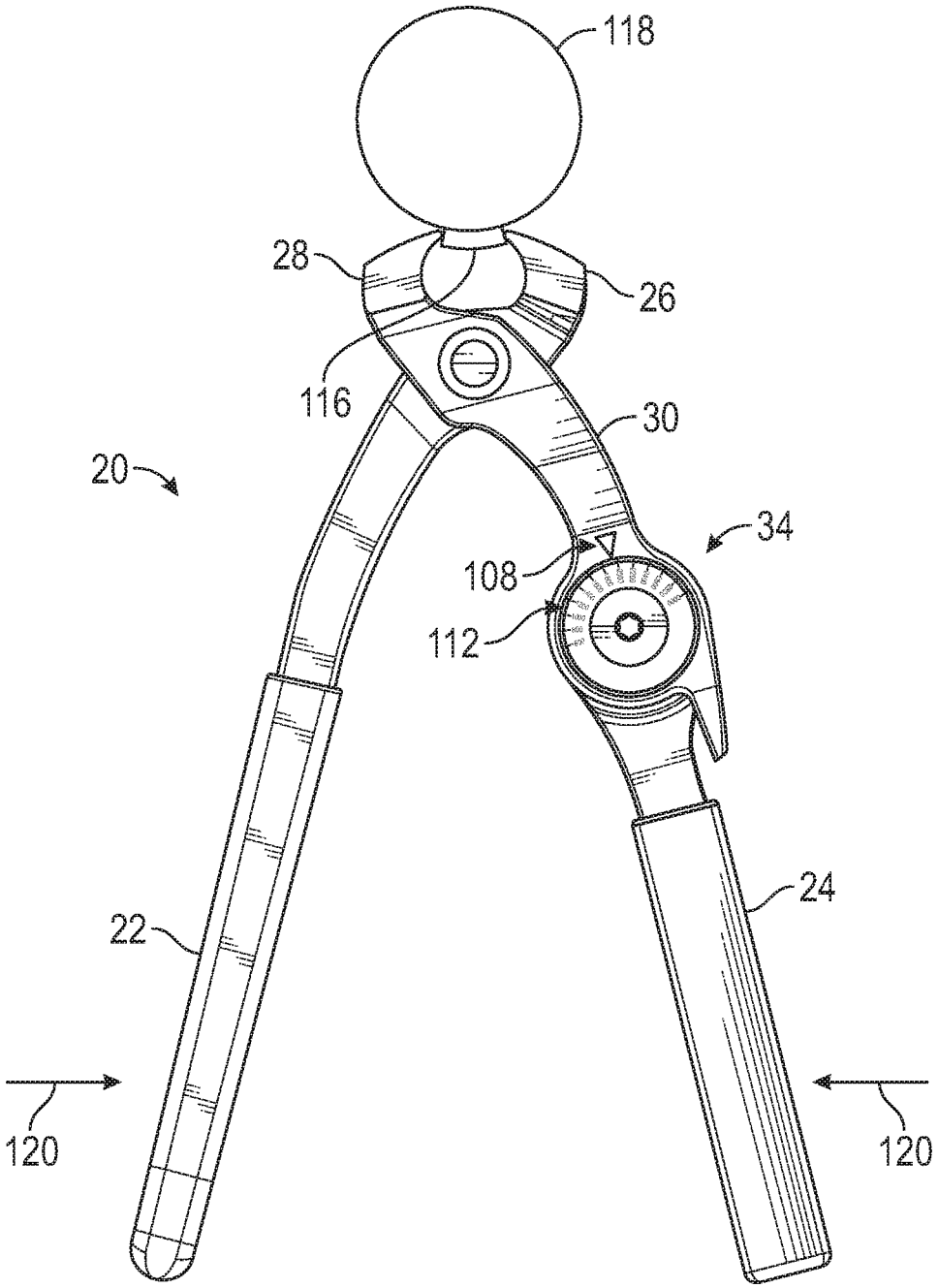
FIG. 9 is a side view of the tool of FIG. 1 in an open position and engaging a clamp.

In operation, the user initially sets the predetermined force that is desired for the clamp being secured by rotating the adjustment member 70 to align the indicia 112 associated with the desired predetermined force with the indicator 108. The handles 22, 24 are then separated to open the jaw portions 26, 28 as shown in FIG. 9. This opens a gap between the jaw portions 26, 28 sufficient to allow the jaw portions 26, 28 to be inserted over raised portion 116 of a clamp 118.

Figure 10:
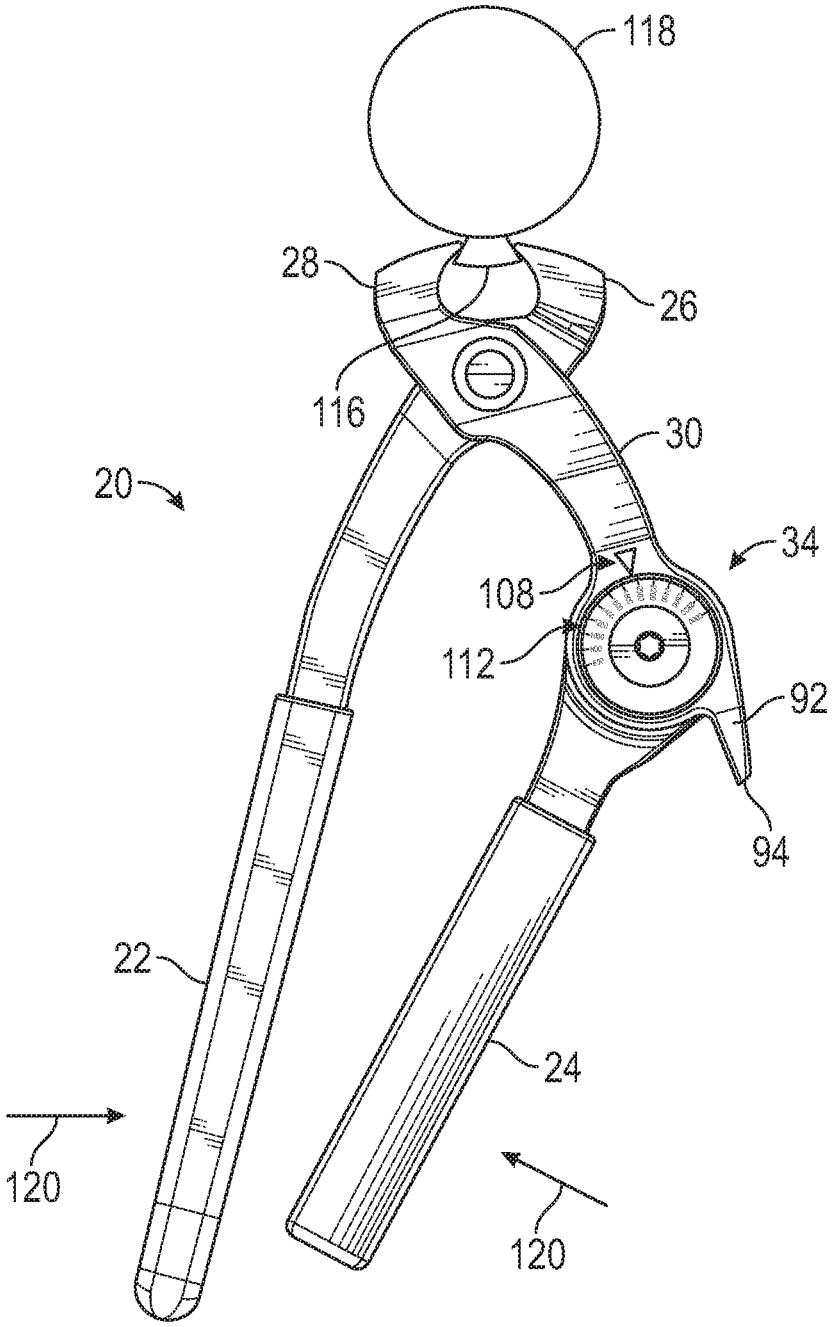
FIG. 10 is a side view of the tool of FIG. 9 with the clamp deformed and a second handle member rotated relative to the arm member.

To close the jaw portions 26, 28 and secure the clamp 118, the user applies a force to the handle members 22, 24 in the directions indicated by arrows 120. This causes the jaw portions 26, 28 to close and deform the raised portion 116 to tighten and secure the clamp 118. When the force applied by the user reaches the predetermined force (as set by the rotation of the adjustment member 70), the second handle member 24 will rotate relative to the arm 30 (FIG. 10) causing the force applied at the jaw portions 26, 28 to decrease. As the second arm 24 rotates relative to the arm 30, the bearing members 59 will move from an initial recess 58 to adjacent recesses 58 (FIG. 11). Once the clamp 118 is secured, the second handle 24 may be reset by the user by applying a force in the opposite direction to rotate the second handle 24 back to the initial position. In an embodiment, the reset rotation of the second handle 24 is limited by the end 94 of arm member 92.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. A tool for securing a clamp, the tool comprising:

a first handle having a first jaw portion on one end;

an arm pivotally coupled to the first handle, the having a second jaw portion on one end;

a second handle adjacent the first handle; and a force adjustment mechanism rotatably coupled between the arm and the second handle, the force adjustment mechanism having a biasing member operably coupled between the arm and an adjustment member, the force adjustment mechanism further having at least one bearing member disposed between the arm and the adjustment member, wherein the second handle rotates relative to the arm based at least in part on a predetermined first force applied on the second handle by the biasing member via the at least one bearing member, wherein the force adjustment mechanism causes a second force applied by the first jaw portion and the second jaw to decrease in response to the predetermined first force.

2. A tool for securing a clamp, the tool comprising a first handle having a first jaw portion on one end;

an arm pivotally coupled to the first handle, the having a second jaw portion on one end;

a second handle adjacent the first handle; and a force adjustment mechanism rotatably coupled between the arm and the second handle, the force adjustment mechanism having a biasing member operably coupled between the arm and an adjustment member, the force adjustment mechanism further having at least one bearing member disposed between the arm and the adjustment member, wherein the second handle rotates relative to the arm based at least in part on a force applied on the second handle by the biasing member via the at least one bearing member;

wherein the force adjustment mechanism further includes a breakaway member coupled to the second handle, the breakaway member having a plurality of first recesses sized to receive the at least one bearing member.

3. The tool of claim 2, wherein:

the breakaway member has a hole extending therethrough; and the force adjustment mechanism includes a fastener extending through the hole, the fastener being rotationally coupled to the arm and engages the adjustment member.

4. The tool of claim 3, wherein the biasing member includes a plurality of spring washers disposed about the fastener and between the adjustment member and the arm.

5. The tool of claim 3, wherein the adjustment member includes an opening on one end having threads sized to engage the fastener and a second opening on an opposite end, the second opening being sized and shaped to receive an adjustment tool.

6. The tool of claim 5, wherein the breakaway member includes a plurality of second recesses disposed between the plurality of first recesses, wherein the at least one bearing member moves from a first recess of the plurality of recesses to a second recess of the plurality of recesses via one of the second plurality of recesses when the second handle rotates relative to the arm.

7. The tool of claim 6, wherein the second handle rotates relative to the arm when the force exceeds a predetermined force.

8. The tool of claim 7, wherein the predetermined force is based at least in part on a compressing of the biasing member caused by rotating the adjustment member relative to the fastener.

9. The tool of claim 2, further comprising at least one o-ring disposed between the breakaway member and the arm.

10. The tool of claim 2, further comprising a cover member coupled to the adjustment member and disposed about the biasing member.

11. The tool of claim 10, wherein the arm includes a recessed area opposite the second jaw portion, the recessed area having a wall disposed between the biasing member and the at least one bearing member, a portion of the cover member being disposed within the recessed area.

12. The tool of claim 11, wherein;

the arm further includes a blind hole extending through a side wall of the recessed area; and the cover member includes a plurality of slots on an outer diameter surface within the recessed area adjacent the blind hole.

13. The tool of claim 12, further comprising:

a second biasing member disposed within the blind hole; and a second bearing member coupled to the second biasing member and arranged to selectively engage one of the plurality of slots.

14. The tool of claim 13, wherein the plurality of slots are circumferentially spaced to indicate a predetermined amount of change in force.

15. A method of securing a clamp, the method comprising:

providing a tool, the tool comprising:

a first handle having a first jaw portion on one end;

an arm pivotally coupled to the first handle, the having a second jaw portion on one end;

a second handle adjacent the first handle; and a force adjustment mechanism rotatably coupled between the arm and the second handle, the force adjustment mechanism having a biasing member operably coupled between the arm and an adjustment member, the force adjustment mechanism further having at least one bearing member disposed between the arm and the adjustment member;

engaging a raised portion of the clamp between the first jaw portion and the second jaw portion;

applying a first force to the first handle and the second handle; and rotating the second handle relative to the arm when the first force is equal to or exceeds a predetermined force; and decreasing a second force applied by the first jaw portion and second jaw portion in response to the rotation of the second handle.

16. The method of claim 15, further comprising rotating the adjustment member to select the predetermined force.

17. The method of claim 16, further comprising compressing the biasing member by rotating the adjustment member.

18. The method of claim 17, wherein the force adjustment mechanism further includes a breakaway member having a plurality of recesses, the at least one bearing member being disposed in the plurality of recesses.

19. The method of claim 18, further comprising moving the at least one bearing from a first recess of the plurality of recesses to a second recess of the plurality of recesses when the second handle rotates relative to the arm.

20. A method of securing a clamp, the method comprising:

providing a tool, the tool comprising:

a first handle having a first jaw portion on one end;

an arm pivotally coupled to the first handle, the having a second jaw portion on one end;

a second handle adjacent the first handle; and a force adjustment mechanism rotatably coupled between the arm and the second handle, the force adjustment mechanism having a biasing member operably coupled between the arm and an adjustment member, the force adjustment mechanism further having at least one bearing member disposed between the arm and the adjustment member;

engaging a raised portion of the clamp between the first jaw portion and the second jaw portion;

applying a force to the first handle and the second handle;

rotating the second handle relative to the arm when the force is equal to or exceeds a predetermined force; and deforming the raised portion in response to the applying the force.

* * * * *